US006010355A

United States Patent [19]

Yang

[11] Patent Number: 6,010,355

[45] Date of Patent: Jan. 4, 2000

[54] PUSHER SWITCH LIGHT SOCKET

[75] Inventor: Wen Ho Yang, Taipei Hsien, Taiwan

[73] Assignee: Sun Lite Sockets Industry, Inc., Taoyuan Hsien, Taiwan

[21] Appl. No.: 09/059,058

[22] Filed: Apr. 7, 1998

[51] Int. Cl.[7] ..... H01R 13/58

[52] U.S. Cl. ..... 439/457

[58] Field of Search ..... 439/457, 438, 439/220

[56] References Cited

U.S. PATENT DOCUMENTS 1,057,320 5/1913 Barr ..... 439/457

4,927,381 5/1990 Shang ..... 439/438

*Primary Examiner*—Paula Bradley
*Assistant Examiner*—Alexander Gilman
*Attorney, Agent, or Firm*—Bacon & Thomas

[57] ABSTRACT a pusher switch light socket essentially relates to one to provide a terminal for receiving and holding in position of lead-in wires, one lead-in wire support is provided to the stand of the socket allowing segregation for the installation of the lead-in wires so to stop any improper pull to the lead-in wire from directly transferring to the terminal to prevent the terminal from falling away or causing poor contact, thus to ensure good transmission quality and safe use of the lighting fixture.

1 Claim, 3 Drawing Sheets

PUSHER SWITCH LIGHT SOCKET

BACKGROUND OF THE INVENTION

The present invention relates to a pusher switch light socket and, more particularly, to one that can prevent a lead-in wire connected and fixed to a lighting fixture from falling away or causing poor contact, thus ensuring a good electrical connection for safe use of the lighting fixture.

The construction of a prior art pusher light socket is illustrated in FIG. 1. The prior art socket is essentially comprised of a stand 1 and a socket 2. The stand 1, which is made of insulation materials, has screw terminals 11 and 12 fixed in position on both sides by locking screws to respectively connected and hold one-phase dual lead-in wires in place. A pusher switch 13 is provided on stand 1 to control turning on or off the lighting fixture. The light socket 2 is made of conductive material and provides a screw base to hold a light bulb in position.

Whereas the switching function of the prior art of the pusher switch light socket relies solely on the screw terminals to connect and hold lead-in wires in place, it is vulnerable to the problem that lead-in wire can fall away from its screw terminal in case the locking screw loosens or the lead-in wire is subjected to an improper pull. In addition, the lead-in wire may have poor contact with its screw terminal 11 or 12, causing intermittent currents which will affect the performance and even could result in a fire hazard due to an overloaded lead-in wire.

Another inventor has modified the prior art by providing terminal jacks 31 and 32 (as illustrated in FIG. 2) instead of the screw terminals 11 and 12 while retaining a stand 3, a light socket 4 and pusher switch 33. The terminal jacks 31 and 32 allow the insertion of plug-in lead-in wires 5. A spring-loaded clamping device inside each of the jacks holds a respective inserted terminal 51 of the lead-in wire 5 in place and prevents it from falling away, overcoming the falling away problem of sockets having lead-in wires held in position by locking screws. The pusher switch light socket illustrated in FIG. 2 has been respectively granted as a ROC Utility Patent (ROC Patent Publication of Sep. 21, 1990, Patent Application No. 78206100) and U.S. Pat. No. 4,927,381 (US Patent Publication of May 22, 1990). However, the terminal 51 to connect lead-in wire 5 of the modified socket is still at risk of falling away when the lead-in wire 5 is subject to improper pull, which will be directly conveyed into the terminal jacks 31 and 32 of the stand 3, even though terminals 51 of the lead-in wire 5 are inserted into terminal jacks 31 and 32.

BRIEF DESCRIPTION OF DRAWINGS

The primary purpose of the present invention is to provide a pusher switch light socket that can prevent a lead-in wire connected and fixed to the lighting fixture from falling away or causing poor contact, and thus ensure a good electrical connection for safe use of the light.

To achieve the aforesaid purpose, a lead-in wire support is provided on the stand of the lighting fixture to facilitate segregation of the lead-in wires during installation and to provide a strain relief so that when the lead-in wire is subject to an improper pull, the pull is frustrated by the wire support without being directly transferred to the terminal provided at the stand for the lead-in wire. The technical means and physical structure of the present invention can be better understood by a preferred embodiment in conjunction with the following drawings.

DESCRIPTION OF PREFERRED EMBODIMENT

Figure 1:
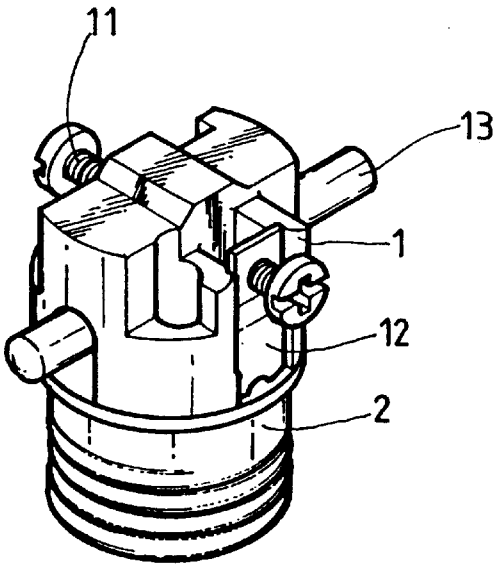
FIG.1 PRIOR ART
FIG. 1 is a sectional view of a prior art pusher switch light socket.
Figure 2:
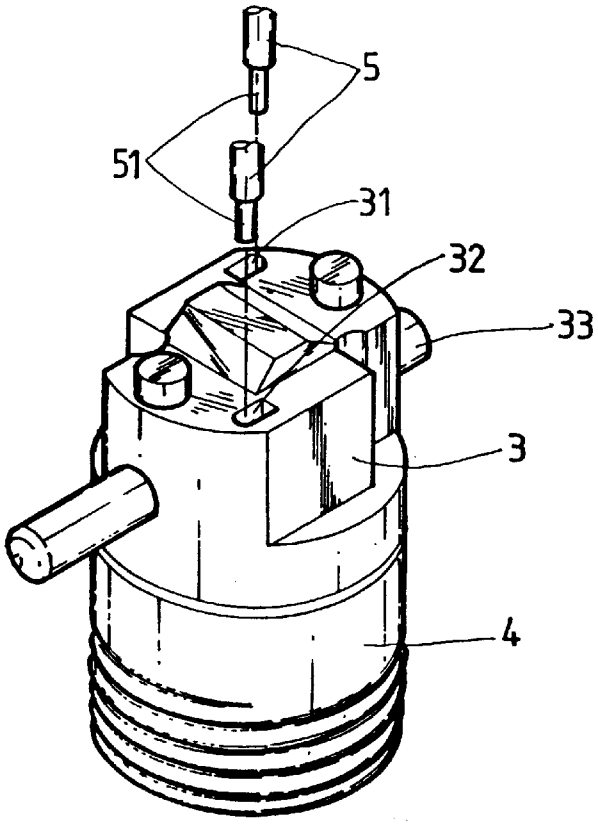
FIG.2 PRIOR ART
FIG. 2 is a sectional view of another prior art pusher switch light socket.
Figure 4:
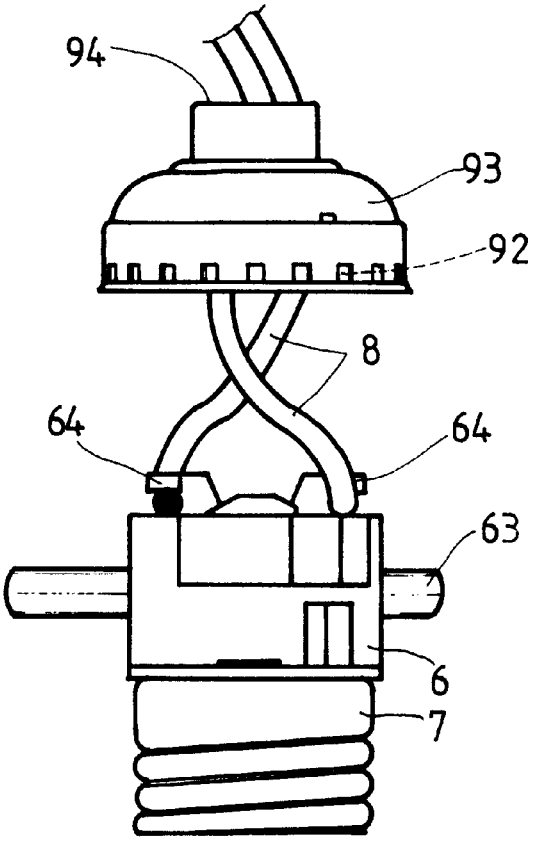
FIG. 4 is a top view of the preferred embodiment of the present invention.
Figure 4:
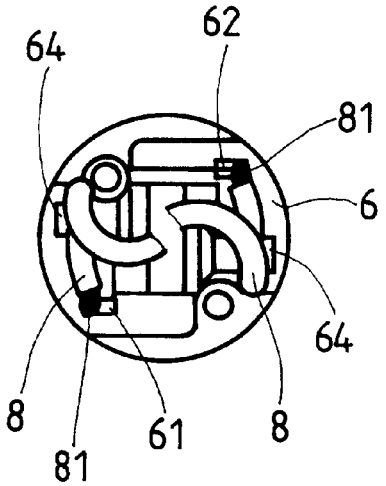
Figure 3:
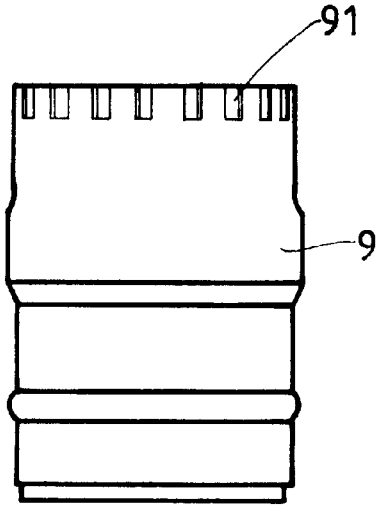
FIG. 3 is a plan view of the preferred embodiment of the present invention.

Referring to FIGS. 3 and 4, the structure of the preferred embodiment of the present invention is identical to the structure of the prior art socket illustrated in FIG. 2 with respect to the stand 6, light socket 7, pusher switch 63 and two terminal jacks 61 and 62, except as follows:

A wire support 64 (also refer to FIG. 6) is provided on the stand 6 and serves to provide segregation of the lead-in wires 8 during installation, so that when either or both of lead-in wires 8 is subjected to an improper pull, the pull is stopped by the wire support 64 without being directly transferred to a terminal 81 of the lead-in wires 8. The wire support 64 alone is capable of ensuring that the terminal 81 holds the lead-in wire in position on the lighting fixture to maintain its safe use.

Wire support 64 and the stand 6 form a square "C" shape to facilitate segregation of the lead-in wires during installation.

In practice, the wire support 64 and those terminal jacks 61 and 62 are provided on the same side 6 and abutted to each other on the stand to facilitate the segregation of the lead-in wires, and the stand 6 is provided with at least one wire support depending on the installation requirements of each lead-in wire.

Figure 6:
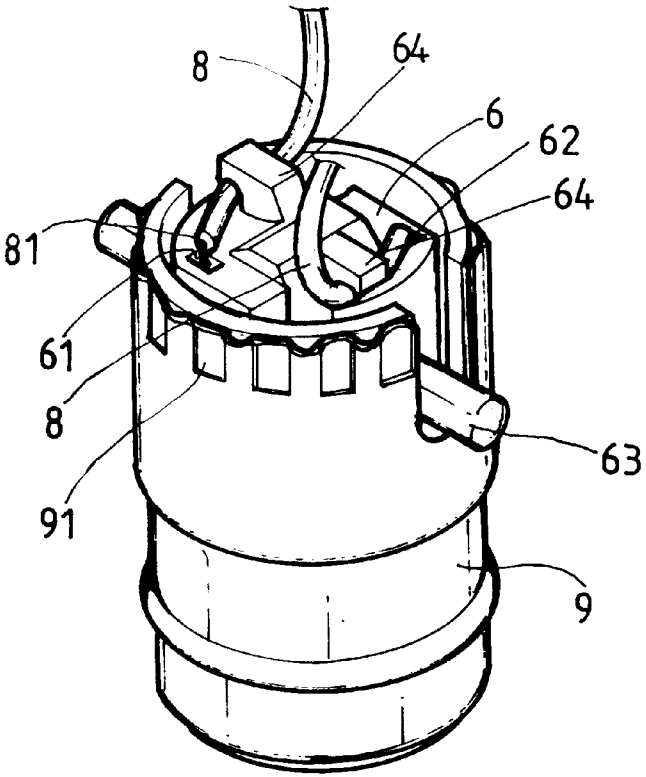
FIG. 6 is a view illustrating the appearance of the preferred embodiment of the present invention with the dust-proof casing removed.
Figure 5:
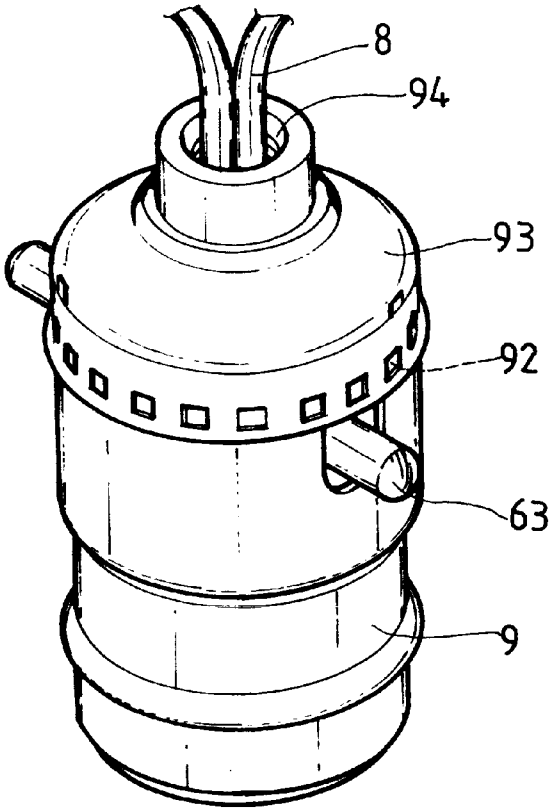
FIG. 5 is a view illustrating the appearance of the preferred embodiment of the present invention with the lead-in wire connected.

Because light socket 7 is made of conductive material, to protect from electric shock, a protective jacket 9, hollow and inter-lined with insulating material is inserted onto said light socket 7 as illustrated in FIGS. 3 and 6. A plurality of restricting convex and concave interleaved walls 91 is further provided around the top edge of the protective jacket 9 and a plurality of mating walls 92 are provided on the inner wall of a dust-proof casing 93 (as illustrated in FIG. 5) to secure the protective jacket 9 in position and stop the invasion of dust. Furthermore, a wire jack 94 is provided at the center of a dome-shaped portion of the dust-proof casing 93 to allow the lead-in wires 8 to pass through the cover and restrict the entry direction of the lead-in wires 8. In turn, stand 6 is given dust-proof protection due to the isolation provided by the coverage of the dust-proof casing 93, and an external pull acting upon the lead-in wires will never be transferred to terminals 81 on the stand 6 since the wire support 64 is also isolated by the coverage provided by said dust-proof casing 93, so to ensure that the terminal 81 of the lead-in wire 6 does not fall away from terminal jacks 61 and 62.

The present invention therefore provides the following additional advantages when compared with those of the prior arts: (1) to protect the lead-in wires inserted and held in position inside the stand from falling away even when subject to improper pull, thereby ensuring safe use of the lighting fixture; (2) to prevent electric shock; and (3) to ensure a good electrical connection of the lead-in wires in conjunction with a dust-proof casing that prevents the invasion of dust and bugs.

I claim:

1. A light socket including:

a stand (3) made of an insulation material, provided with two terminal jacks (31, 32) to receive and hold in position power lead-in wires (5,5);

a socket (4) made of a conductive material fixed to the stand (3);

a screw base to receive and hold a bulb in position; pusher switch (63) to control turning on or off the light and at least a one lead-in wire support (33); characterized in that the wire support (33) is molded integrally with the stand (33); said wire support (33) includes a rectangular in plane cantilever portion having a top surface substantially parallel to the top surface of the stand (3) and an inner surface substantially curvilinear; said configuration simplifies molding and an insertion of the wire (5) in the position.

* * * * *

UNITED STATES PATENT AND TRADEMARK OFFICE

CERTIFICATE OF CORRECTION

PATENT NO. : 6,010,355
DATED : January 4, 2000
INVENTOR(S) : Wen Ho YANG

It is certified that error appears in the above-identified patent and that said Letters Patent is hereby corrected as shown below:

All numbers and parentheses should be removed from claim 1. Claim 1 should read as follows:

--1. A light socket including:
a stand made of an insulation material, provided with two terminal jacks to receive and hold in position power lead-in wires; a socket made of a conductive material fixed to the stand; a screw base to receive and hold a bulb in position; pusher switch to control turning on or off the light and at least a one lead-in wire support; characterized in that the wire support is molded integrally with the stand; said wire support includes a rectangular in plane cantilever portion having a top surface substantially parallel to the top surface of the stand and inner surface substantially curvilinear; said configuration simplifies molding and an insertion of the wire in the position.--

Signed and Sealed this

Third Day of April, 2001

*Attest:*

Nicholas P. Godici

NICHOLAS P. GODICI

*Attesting Officer*

*Acting Director of the United States Patent and Trademark Office*